US009284615B2

(12) United States Patent
Rivas Torres et al.

(10) Patent No.: US 9,284,615 B2
(45) Date of Patent: Mar. 15, 2016

(54) ACID HYDROLYSIS OF LIGNOCELLULOSIC BIOMASS WITH MINIMAL USE OF AN ACID CATALYST

(75) Inventors: Beatriz Rivas Torres, Arenzano (IT); Michelle Marrone, Novi Ligure (IT); Irene Bozzano, Genoa (IT)

(73) Assignee: Biochemtex S.p.A., Tortona (IT)

( * ) Notice: Subject to any disclaimer, the term of this patent is extended or adjusted under 35 U.S.C. 154(b) by 0 days.

(21) Appl. No.: 14/239,613

(22) PCT Filed: Aug. 21, 2012

(86) PCT No.: PCT/EP2012/066263
§ 371 (c)(1),
(2), (4) Date: Feb. 19, 2014

(87) PCT Pub. No.: WO2013/026849
PCT Pub. Date: Feb. 28, 2013

(65) Prior Publication Data

US 2014/0196715 A1 Jul. 17, 2014

(30) Foreign Application Priority Data

Aug. 24, 2011 (IT) ..... TO2011A0773

(51) Int. Cl.
*C13K 13/00* (2006.01)
*C13K 1/02* (2006.01)

(52) U.S. Cl.
CPC ..... *C13K 1/02* (2013.01); *C13K 13/002* (2013.01)

(58) Field of Classification Search
None
See application file for complete search history.

(56) References Cited

U.S. PATENT DOCUMENTS

| | | | | |
|---|---|---|---|---|
| 6,423,145 | B1 * | 7/2002 | Nguyen et al. | 127/37 |
| 2007/0125369 | A1 * | 6/2007 | Olson et al. | 127/37 |
| 2012/0289692 | A1 * | 11/2012 | Gray et al. | 536/56 |

FOREIGN PATENT DOCUMENTS

| | | | |
|---|---|---|---|
| JP | 2005239979 | A | 9/2005 |
| WO | 9814270 | A1 | 4/1998 |
| WO | 2010071805 | A2 | 6/2010 |

OTHER PUBLICATIONS

Plug-Flow Reactor for Continuous Hydrolysis of Glucans and Xylans from Pretreated Corn Fiber Youngmi Kim et al. Energy and Fuels, vol. 19, pp. 2189-2200, 2005.*

Heterogeneous Hydrolysis of Cellulose with High Polymer Acids. Part 3. The Acid Hydrolysis of Cellulose with Finely Divided Cation-Exchange Resin in the Hydrogen Form. Nils Hartler et al. Journal of Polymer Science, vol. 56, pp. 425-434, (1962).*

MSDS—Aluminum Chloride LabChem, pp. 1-6, revised Feb. 10, 2011.*

(Continued)

*Primary Examiner* — Melvin C Mayes
*Assistant Examiner* — Douglas Call
(74) *Attorney, Agent, or Firm* — Edwin A. Sisson, Attorney at Law, LLC; Jeffrey J. Banyas

(57) ABSTRACT

This specification describes a process of producing a monomeric sugar stream, with little or no acid addition, from an oligomeric sugar solution using the intrinsic features of the mildly pre-treated vegetable or ligno-cellulosic biomass, namely the presence of naturally occurring salts. This is accomplished by lowering the pH of the oligomer sugar solution with little or no addition of an acid and then exposing the biomass with the lowered pH to an elevated temperature greater than 80° C. for a time sufficient to hydrolyze the components of the biomass.

11 Claims, 2 Drawing Sheets

(56) References Cited

OTHER PUBLICATIONS

Boussaid et al., "Sugar Recovery and Fermentability of Hemicellulose Hydrolysates from Steam-Exploded Softwoodsd Containing Bark", Biotechnol. Prog., 2001, pp. 887-892, vol. 17, No. 5, American Chemical Society and American Institute of Chemical Engineers.
Duarte et al., "Comparison of Two Posthydrolysis Processes fo Brewery's Spent Grain Autohydrolysis Liquor to Produce a Pentose-Containing Culture Medium", Applied Biochemistry and Biotechnology, 2004, pp. 1041-1058, vol. 113-116, Humana Press, Inc.
Carvalheiro et al., "Hemicellulose biorefineries: a review on biomass pretreatments", Journal of Scientific & Industrial Research, Nov. 2008, pp. 849-864, vol. 67.
Shevchenko et al., "Optimization of monosaccharide recovery by post-hydrolysis of the water-soluble hemicellulose component after steam explosion of softwood chips", Bioresource Technology, 2000, pp. 207-211, vol. 72, Elsevier Science Ltd.
Garrote et al., "Generation of xylose solutions from Eucalyptus globulus wood by autohydrolysis-posthydrolysis processes: posthydrolysis kinetics", Bioresource Technology, 2001, pp. 155-164, vol. 79, Elsevier Science Ltd.
Garrote et al, "Manufacture of xylose-based fermentation media from corncobs by posthydrolysis of autohydrolysis liquors", Applied Biochemistry and Biotechnology, 2001, pp. 195-207, vol. 95, Humana Press, Inc.
Duarte et al, "Dilute acid hydrolysis of wheat straw oligosaccharides", Applied Biochemistry and Biotechnology, 2009, pp. 116-126, vol. 153, Humana Press, Inc.
Girio et al., "Hemicelluloses for fuel ethanol: A review", Bioresource Technology, 2010, pp. 4775-4800, vol. 101, Elsevier Science Ltd.
Kim et al., "Plug-flow reactor for continuous hydrolysis of glucans and xylans from pretreated corn fiber", Energy & Fuels, 2005, pp. 2189-2200, vol. 19, American Chemical Society.
Vazquez et al., "Enzymatic processing of crude xylooligomer solutions obtained by autohydrolysis of eucalyptus wood", Food Biotechnology, 2002, pp. 91-105, vol. 16, No. 2, Marcel Dekker, Inc., New York, US.

* cited by examiner

ACID HYDROLYSIS OF LIGNOCELLULOSIC BIOMASS WITH MINIMAL USE OF AN ACID CATALYST

PRIORITY AND CROSS REFERENCES

This patent application claims the priority from International Application PCT/EP2012/066263 filed on 21 Aug. 2012 and Italian Patent Application TO2011A000773 filed on 24 Aug. 2011 the teachings of both of which are incorporated in their entirety.

BACKGROUND

Acid hydrolysis of biomass and cellulose is known in the art. It is practiced both in homogenous or heterogeneous manners.

Usually processes to obtain a monomeric sugar stream from an oligomeric sugar stream coming from pre-treated lignocellulosic material (e.g. autohydrolysis, hot water washing or steam explosion) seek to limit the monosaccharide transformation into degradation products during post hydrolysis of the oligosaccharides into monomers. (Duarte et al., 2004; Girio et al., 2010).

Post hydrolysis, also known as hydrolysis, options for the xylo-oligo-saccharides (XOs) hydrolysis are acid catalyzed (Boussaid et al., 2001), or enzymatic catalysed processes (Duarte et al., 2004) (Carvalheiro et al., 2008).

The main factors affecting monosaccharide recovery in dilute-acid chemical post hydrolysis are catalyst concentration, reaction time, and temperature. The acid process was applied to hydrolysates obtained from softwoods (Shevchenko et al., 2000), hardwoods (Garrote et al., 2001a) and herbaceous materials (Garrote et al., 2001b). The main catalyst reported is sulphuric acid (Duarte et al., 2009; Shevchenko et al., 2000), although, other catalysts can be employed (such as phosphoric acid, hydrochloric acid, formic acid). Under fully optimized post hydrolysis conditions, sugar recovery can be close to 100% (Duarte et al., 2004, 2009; Garrote et al., 2001a,b; Shevchenko et al., 2000), as compared to the standard dilute acid hydrolysis (121° C., 4% $H_2SO_4$ and 60 min) which is generally used for the quantitative acid hydrolysis of oligosaccharides. During the acid hydrolysis of oligosaccharides, degradation reactions lead to the formations of many compounds, particularly, 5-hydroxymethylfurfural (HMF), furfural, formic and levulinic acids, which can inhibit further bioconversion steps, reducing the sugar yields of the process (Duarte et al., 2009).

Additionally, acid catalysts usually involve increasing the concentration of non-sugar compounds up to a value incompatible with the economic and environmental sustainability.

Kim et al (Youngmi Kim, Rick Hendrickson, Nathan Mosier, and Michael R. Ladisch, "Plug-Flow Reactor for Continuous Hydrolysis of Glucans and Xylans from Pretreated Corn Fiber", Energy & Fuels 2005, 19, 2189-2200), describes a heterogeneous system when the aqueous stream is first contacted with the cation exchanger at room temperature where proteins, phenolics, minerals, and other catalyst fouling components are removed. The material is then passed over a packed-bed of the same catalyst at 130° C. to give 88% hydrolysis for a space time of 105 min.

The process in Kim et al is temperature limited because the catalyst degrades at temperatures greater than 130° C. and catalyst fouling also increases with increasing temperature above than 130° C.

Alternatively, the post hydrolysis of oligosaccharides can be catalysed by enzymes. Because the complex hemicellulose structure is still present in the oligosaccharides obtained from the pre-treatment, the action of several enzyme activities is usually required for the complete hydrolysis (e.g., endoxylanase, exoxylanase, β-xylosidase and accessory activities like acetyl xylanesterase, α-glucuronidase, α-arabinofuranosidase, and feruloyl esterase); hence potentially turning the process uneconomical (Vázquez et al., 2002; Duarte et al., 2009). Moreover, toxic/inhibitors compounds potentially present in the hydrolysate can significantly reduce enzyme activity (Carvalheiro et al., 2008). Regardless of all theses aspects, the enzymatic posthydrolysis presents the advantage of minimizing the monosaccharide degradation reactions.

There exists therefore, a need for a homogeneous acidic catalyzed hydrolysis which produces few degradation products.

SUMMARY

This specification discloses a process for the hydrolysis of oligosaccharides present in a liquid ligno-cellulosic biomass feed stream derived from pre-treated ligno-cellulosic biomass, wherein the process comprises the steps of A. Creating an acidic stream from the liquid biomass feed stream by increasing the number of $H^+$ ions to the liquid biomass feed stream in an amount sufficient so that the pH of the acidic stream is at least 0.5 pH units less than the pH of the liquid biomass feed stream prior to the addition of the $H^+$ ions wherein less than 80% of the total amount of $H^+$ ions added to the feed stream are derived from an acid or acids, and B. Hydrolyzing the acidic stream by increasing the temperature of the acidic stream to a hydrolysis temperature greater than 80° C.

It is further disclosed that at least a portion of the $H^+$ ions come from decationization using an ion exchange agent and at least a portion of the acidic stream is separated from the ion exchange agent before hydrolyzing the separated portion of the acidic stream. It is also further disclosed that less than 90% of the total amount of $H^+$ ions added to the feed stream are derived from an acid or acids.

It is further disclosed that the pH of the acidic stream is less than at least 2.5. It is also further disclosed that at least a portion of the $H^+$ ions is derived from an acid or acids added to either the feed stream or the acidic stream, or both prior to hydrolysis and/or during the hydrolysis step.

A salt may also be added to the process and at least a portion of the salt may be added to the feed stream prior to adding the $H^+$ ions to the feed stream.

The hydrolysis temperature of the acidic stream can be maintained in a temperature range for a time within the range of 1 sec to 4 hours and the hydrolysis temperature may be within the range of 80° C. to 200° C.

It is also disclosed to concentrate the feed stream and/or the acidic stream thus the feed stream comprises a concentration of xyloligomers and the concentration of the xyloligomers in the feed stream can be increased prior to decationization and the concentration of the xyloligomers in the acidic stream can be increased prior to hydrolysis.

It also disclosed that the proton concentration may be increased in-situ, wherein the process comprises the steps of A. increasing the number of $H^+$ ions to the liquid biomass feed stream in an amount sufficient so that the pH of the liquid biomass feed stream is at least 0.5 pH units less than the pH of the liquid biomass feed stream prior to the addition of the $H^+$ ions, and B. Hydrolyzing the liquid biomass feed stream by at a hydrolysis temperature greater than 80° C. wherein, C. at least a portion of the $H^+$ are created by adding a compound which does not contain $H^+$ ions capable of disassociating in water to the feed stream, but the compound catalyzes a reaction, or the compound itself reacts, with component(s) already present in the liquid biomass feed stream to create at least a portion of the $H^+$ ions.

DETAILED DESCRIPTION

Figure 1:
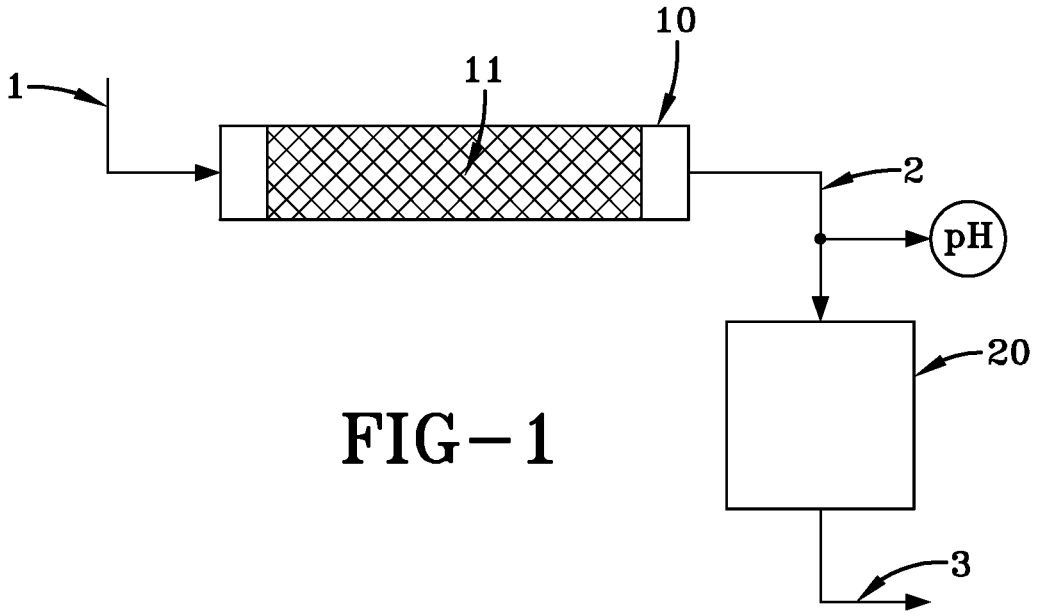
FIG. 1 is a schematic of a first embodiment of the process.

This specification discloses a manner to conduct acidic hydrolysis of a ligno-cellulosic biomass stream by contacting components of the ligno-cellulosic biomass with very little or no conventional acid or acids. Conventional acid(s) are those acids which donate a proton ($H^+$) and will react with a base to form a salt. Conventional acid(s) are not those acids which create an acidic environment by reacting with something else to generate the proton, such as $AlCl_3$ which reacts with water to form HCl, the actual conventional acid. As such, Aluminum Chloride is known as a Lewis Acid and is not considered a conventional acid for the purpose of this specification.

This process is useful for feed streams obtained from pre-treatment of ligno-cellulosic biomass. This process is also useful for the hydrolysis of pectins, such as those found in fruits like orange peels, apple skins, for example.

It is believed that this process will work on any stream containing polymeric sugars. For example, inulin is the polymer of fructose. Preferably, the solution will contain non-acid salts, however, a salt could be added to the stream.

Pre-treated plant biomass is a preferred feedstock. Apart from starch, the three major constituents in plant biomass are cellulose, hemicellulose and lignin, which are commonly referred to by the generic term lignocellulose. Polysaccharide-containing biomass is a generic term that includes both starch and lignocellulosic biomasses. Therefore, some types of feedstocks can be plant biomass, polysaccharide containing biomass, and lignocellulosic biomass. To be clear, in this specification, a ligno-cellulosic biomass may and/or may not contain starch.

This process is primarily aimed at pre-treated ligno-cellulosic feedstock.

The feedstock can be free of starch, substantially free of starch, or have a starch content of 0. Starch, if present, can be less than 75% by weight of the dry content. There is no preferred starch range as its presence is not believed to affect the hydrolysis of the cellulose. Ranges for the starch amount, if present, are between 0 and 75% by weight of the dry content, 0 to 50% by weight of the dry content, 0 to 30% by weight of the dry content and 0 to 25% by weight of the dry content.

The pre-treatment is often used to ensure that the structure of the lignocellulosic content is rendered more accessible to the catalysts, such as enzymes, and at the same time the concentrations of harmful inhibitory by-products such as acetic acid, furfural and hydroxymethyl furfural remain substantially low.

There are several pre-treatment strategies many of which may yet be invented. The current strategies imply subjecting the lignocellulosic material to temperatures between 110-250° C. for 1-60 min e.g.: The typical processes of today are:

- Hot water extraction
- Steam explosion
- Almost any pre-treatment with subsequent removal of reaction inhibitors.

If a hydrothermal pre-treatment is chosen, the following conditions are preferred:

- Pre-treatment temperature: 110-250° C., preferably 120-240° C., more preferably 130-230° C., more preferably 140-220° C., more preferably 150-210° C., more preferably 160-200° C., even more preferably 170-200° C. or most preferably 180-200° C.
- Pre-treatment time: 1-60 min, preferably 2-55 min, more preferably 3-50 min, more preferably 4-45 min, more preferably 5-40 min, more preferably 5-35 min, more preferably 5-30 min, more preferably 5-25 min, more preferably 5-20 min and most preferably 5-15 min.
- Dry matter content after pre-treatment is preferably at least 20% (w/w).

Polysaccharide-containing biomasses according to the present invention include any material containing polymeric sugars e.g. in the form of starch as well as refined starch, cellulose and hemicellulose. However, as discussed earlier, the starch is not necessarily a major component.

As described below, the disclosed process operates upon the principle of the hydrolysis of ligno-cellulosic biomass in the presence of an acidic environment. The hydrolysis of lignocellulosic biomass in the presence of an acidic environment is experimentally established in the literature for multiple types of ligno-cellulosic biomass. The unifying concept being the presence of polymeric sugars in the form that can be hydrolyzed in acid environment at elevated temperature. Thus, while the examples are to the disclosed species of lignocellulosic biomass, there is no known scientific reason as to why the disclosed process should fail to work upon other ligno-cellulosic biomasses which contain polymeric sugars known to be hydrolyzable in an acidic environment (low pH).

Relevant types of lignocellulosic biomasses for hydrolysis according to the present invention may include biomasses derived from agricultural crops such as e.g.: containing grains; corn stover, bagasse, straw e.g. from rice, wheat, rye, oat, barley, rape, sorghum; tubers e.g. beet, potato.

The ligno-cellulosic biomass feedstock is preferably from the family usually called grasses. The proper name is the family known as Poaceae or Gramineae in the Class Liliopsida (the monocots) of the flowering plants. Plants of this family are usually called grasses, and indude bamboo. There are about 600 genera and some 9,000-10,000 or more species of grasses (Kew Index of World Grass Species).

Poaceae includes the staple food grains and cereal crops grown around the world, lawn and forage grasses, and bamboo. Poaceae generally have hollow stems called culms, which are plugged (solid) at intervals called nodes, the points along the culm at which leaves arise. Grass Leaves are usually alternate, distichous (in one plane) or rarely spiral, and parallel-veined. Each leaf is differentiated into a lower sheath which hugs the stem for a distance and a blade with margins usually entire. The leaf blades of many grasses are hardened with silica phytoliths, which helps discourage grazing animals. In some grasses (such as sword grass) this makes the edges of the grass blades sharp enough to cut human skin. A membranous appendage or fringe of hairs, called the ligule, lies at the junction between sheath and blade, preventing water or insects from penetrating into the sheath.

Grass blades grow at the base of the blade and not from elongated stem tips. This low growth point evolved in response to grazing animals and allows grasses to be grazed or mown regularly without severe damage to the plant.

Flowers of Poaceae are characteristically arranged in spikelets, each spikelet having one or more florets (the spikelets are further grouped into panicles or spikes). A spikelet consists of two (or sometimes fewer) bracts at the base, called glumes, followed by one or more florets. A floret consists of the flower surrounded by two bracts called the lemma (the external one) and the palea (the internal). The flowers are usually hermaphroditic (maize, monoecious, is an exception) and pollination is almost always anemophilous. The perianth is reduced to two scales, called lodicules, that expand and contract to spread the lemma and palea; these are generally interpreted to be modified sepals.

The fruit of Poaceae is a caryopsis in which the seed coat is fused to the fruit wall and thus, not separable from it (as in a maize kernel).

There are three general classifications of growth habit present in grasses which work in the process; bunch-type (also called caespitose), stoloniferous and rhizomatous.

The success of the grasses lies in part in their morphology and growth processes, and in part in their physiological diversity. Most of the grasses divide into two physiological groups, using the C3 and C4 photosynthetic pathways for carbon fixation. The C4 grasses have a photosynthetic pathway linked to specialized Kranz leaf anatomy that particularly adapts them to hot climates and an atmosphere low in carbon dioxide.

C3 grasses are referred to as "cool season grasses" while C4 plants are considered "warm season grasses". Grasses may be either annual or perennial. Examples of annual cool season are wheat, rye, annual bluegrass (annual meadowgrass, *Poa annua* and oat). Examples of perennial cool season are orchardgrass (cocksfoot, *Dactylis glomerata*), fescue (*Festuca* spp), Kentucky Bluegrass and perennial ryegrass (*Lolium perenne*). Examples of annual warm season are corn, sudangrass and pearl millet. Examples of Perennial Warm Season are big bluestem, indiangrass, bermudagrass and switchgrass.

One classification of the grass family believed to work in the process recognizes twelve subfamilies: These are 1) anomochlooideae, a small lineage of broad-leaved grasses that includes two genera (Anomochloa, Streptochaeta); 2) Pharoideae, a small lineage of grasses that includes three genera, including Pharus and Leptaspis; 3) Puelioideae a small lineage that includes the African genus *Puelia;* 4) Pooideae which includes wheat, barely, oats, brome-grass (Bronnus) and reed-grasses (Calamagrostis); 5) Bambusoideae which includes bamboo; 6) Ehrhartoideae, which includes rice, and wild rice; 7) Arundinoideae, which includes the giant reed and common reed 8) Centothecoideae, a small subfamily of 11 genera that is sometimes included in Panicoideae; 9) Chloridoideae including the lovegrasses (Eragrostis, ca. 350 species, including teff), dropseeds (Sporobolus, some 160 species), finger millet (*Eleusine coracana* (L.) Gaertn.), and the muhly grasses (Muhlenbergia, ca. 175 species); 10) Panicoideae including panic grass, maize, sorghum, sugar cane, most millets, fonio and bluestem grasses. 11) Micraioideae; 12) Danthoniodieae including pampas grass; with *Poa* which is a genus of about 500 species of grasses, native to the temperate regions of both hemispheres.

Agricultural grasses grown for their edible seeds are called cereals. Three common cereals are rice, wheat and maize (corn). Of all crops, 70% are grasses.

Sugarcane is the major source of sugar production. Grasses are often used for construction. Scaffolding made from bamboo is able to withstand typhoon force winds that would break steel scaffolding. Larger bamboos and Arundo donax have stout culms that can be used in a manner similar to timber, and grass roots stabilize the sod of sod houses. Arundo is used to make reeds for woodwind instruments, and bamboo is used for innumerable implements.

Therefore a preferred ligno-cellulosic biomass is selected from the group consisting of the grasses. Alternatively phrased, the preferred lignocellulosic biomass is selected from the group consisting of the plants belonging to the Poaceae or Gramineae family. In most instances the starch will not have been extracted. Thus another preferred ligno-cellulosic biomass is one selected from the group consisting of the grasses which have not had the starch extracted. Alternatively phrased, the preferred lignocellulosic biomass is selected from the group consisting of the plants belonging to the Poaceae or Gramineae family which has not had its starch extracted. Extracted is different from removed. The corn plant has the ear and the stover. Removal of the ear removes the primary starch component but is not extracting the starch. Extracting the starch is separating the starch from the cellulosic starch composition through a chemical or physical process other than cutting or chopping.

The lignocellulosic biomass may be cut into pieces where 20% (w/w) of the biomass preferably ranges within 26-70 mm, before pre-treatment. The pre-treated material has preferably a dry matter content above 20% before entering the process. Besides liberating the carbohydrates from the biomass, the pre-treatment process sterilizes and partly dissolves the biomass and at the same time washes out potassium chloride from the lignin fraction.

The pre-treated feedstreams of ligno-cellulosic biomass usually contain sugars from 20% to 40% of total soluble compounds; while 10% to 20% of non-sugar compounds are inorganic salts. These inorganic salts are often the salts of Calcium and Magnesium cations. While other cations may also be present, the presence of cations is beneficial to the process.

The liquid biomass feed stream will comprise water, sugars which includes the monomeric sugars and oligomeric sugars, salts which are disassociated into anions and cations in the liquid biomass feed stream, optionally phenols, furfural, oils and acetic acid. The feed stream will in particular contain xlyloligomers which are oligomers and polymers containing xylose.

Ideally, the concentration of the total sugars in the liquid biomass feed stream should be in the range of 0.1 to 300 g/L, with 50 to 290 g/L being more preferred, and 75 to 280 g/L even more preferred with 100 to 250 most preferred. This implies concentrating the sugars from their natural occurring concentrations after pre-treatment.

The process contemplated comprises at least two chemical steps. The first step is to create an acidic stream from a liquid biomass feed stream. This is accomplished by increasing the amount of $H^+$ ions to the liquid biomass feed stream to create the acidic stream. After the desired pH is obtained, the next step is hydrolyzing the oligosaccharides in the acidic stream by raising the temperature of the acidic stream to a hydrolysis temperature for the hydrolysis reaction to occur creating a hydrolyzed stream. After hydrolysis, the hydrolyzed stream can be passed to other unit operations for further processing.

Figure 2:
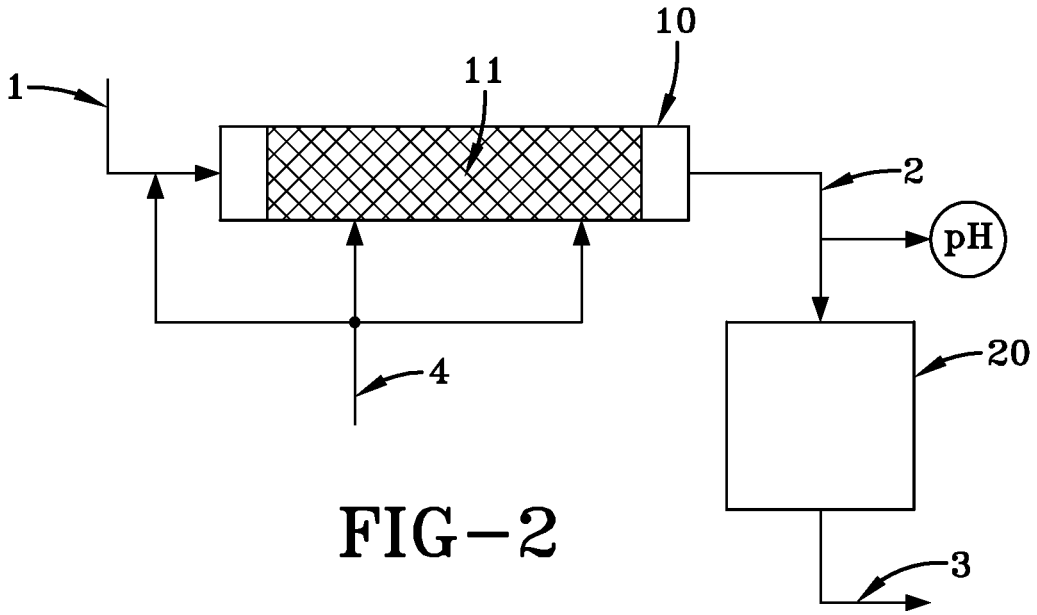
FIG. 2 is a schematic of a second embodiment of the process.

Referring to the figures, starting with FIG. 1, which is an embodiment of the process, the first stream labelled 1 is the liquid biomass feed stream. The stream labelled 2 is the acidic stream. The stream labelled 3 is the hydrolyzed stream. The stream labelled 4 in FIG. 2 is the stream containing the cations added to the streams prior to, or during decationization. The various entry points into the process indicate multiple possible entry points. The stream labelled 5, (FIG. 3) contains the compound which is converted or reacts when in contact with the process stream and releases $H^+$ ions into the stream. The stream labelled 6 (FIG. 4) contains the compound which is converted or reacts when in contact with the process stream and releases $H^+$ ions into the stream. In the embodiment in FIG. 4, the compound is directly added to the hydrolysis reactor. It should be pointed out that an acid or acids could equally be added through streams 5 and/or 6.

Vessel 10 is the decationization vessel, with component 11 being the ion exchange resin. The word pH shows a preferred location where the pH can be measured. The vessel labelled 20 is the hydrolysis vessel.

While the creation of the acidic stream can be done in any manner which increases the concentration of $H^+$ ions, a preferred embodiment is to take advantage of the salt content of the feed stream. In order to obtain the required acidity for the hydrolysis step, the content of salts in the feed stream can be reduced via cation exchange while at the same time replacing the cations with $H^+$ ions. While the salts may naturally occur in the biomass, they can also be added as part of the pre-treatment processes or prior to or during the creation of the acidic stream.

As shown in the experimental section, good results were obtained by concentrating the feed stream after pre-treatment. This concentration can be done by the removal of water. A 50% removal of water increases the concentration of the non-water species by two. While various concentration increases are acceptable, at least a two fold increase in the concentration of the xyloligomers in the feed stream is preferred, with at least a fourfold increase in the concentration of the xyloligomers in the in the feed stream more preferred and at least a six fold increase in the concentration of the xyloligomers in the feed stream most preferred.

The acidic stream can also be concentrated. While various concentration increases are acceptable, at least a two fold increase in the concentration of the xyloligomers in the acidic stream is preferred, with at least a fourfold increase in the concentration of the xyloligomers in the acidic stream more preferred and at least a six fold increase in the concentration of the xyloligomers in the acidic stream most preferred.

The process of reducing the amount of cations of the salts, called decationization, removes the cations by exchanging them with $H^+$ ions. One way the cations in the solution can be replaced by $H^+$ ions is by using an ion exchange resin. The cations can also be exchanged using a membrane. For example, Dupont's Nafion® PFSA Resins can be used as resins in an exchange column or as a membrane through which the solution is passed. These are perfluorinated resins in the sulfonyl fluoride (—$SO_2F$) form.

If a decationizing resin (ion exchange resin) or ion exchange membrane is used, an additional step of separating at least a portion of the acidic stream from the ion exchange media before subjecting the separated portion to the hydrolysis temperatures may be needed. Preferably, all the ion exchange media is removed from the acidic stream before hydrolyzing the oligosaccharides in the acidic stream.

While the concentration of the natural occurring salts is not so critical, it should be recognized that the amount of salts present influences the amount of $H^+$ ions that can be increased (added to the liquid) via ion exchange. The amount of $H^+$ ions also determines the pH of the acidic stream. These salts can be concentrated according to the steps outlined above.

Should the feed stream not have sufficient salts with cations, one can add a salt or cations in another manner to the feed stream prior to the creation of the acidic stream, which includes prior to and/or during decationization, and/or after decationization, or combination thereof. Preferably, the salts of Magnesium, Calcium, Sodium, Potassium can be used. Preferably salts with a monovalent cation are used as the cation will not damage the ion exchange media as much as a bivalent ion. The ion associated with the added salt should be selected so as to benefit, or at least not create problems later in the process or in subsequent process. For example, calcium carbonate is preferred over magnesium sulfate as the sulfur is known to cause problems in later processing. FIG. 2 discloses some of the points where these additional salts may be added.

Figure 3:
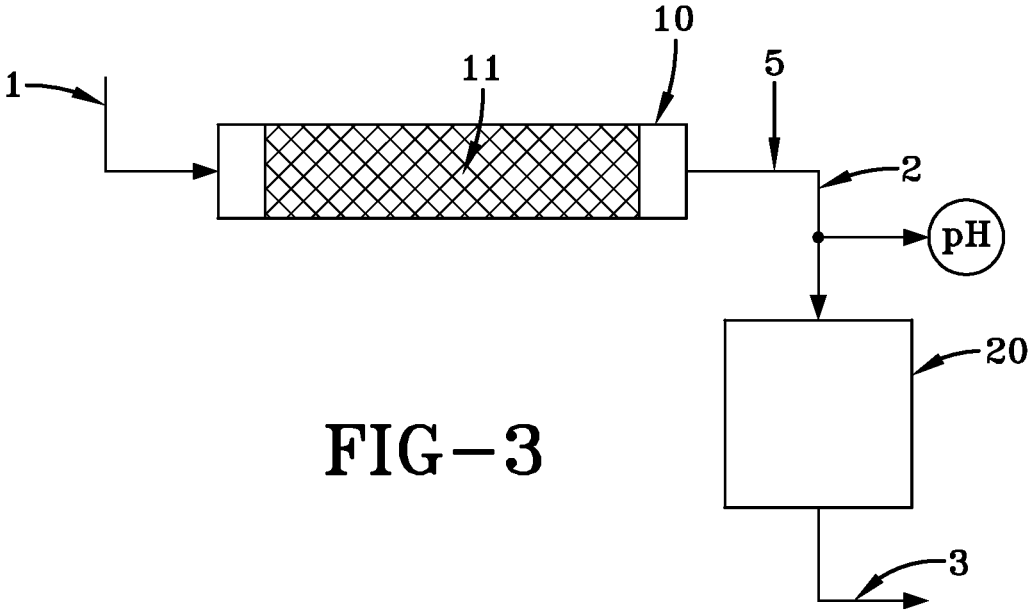
FIG. 3 is a schematic of a third embodiment of the process.
Figure 4:
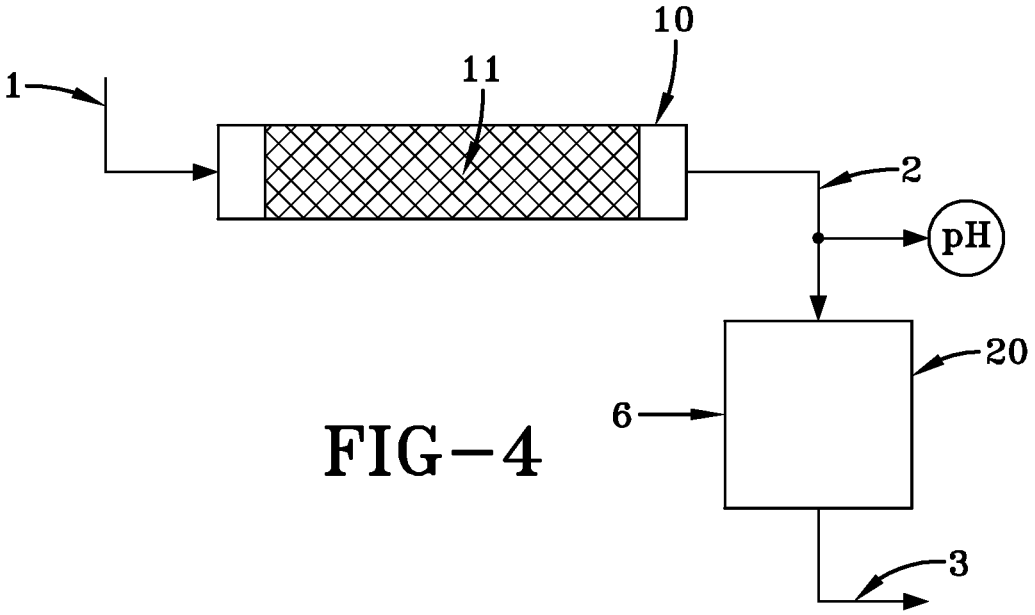
FIG. 4 is a schematic of a fourth embodiment of the process.

Should one not want to remove the cations or only remove a small amount of the cations, one may add additional $H^+$ ions to the stream. The amount of $H^+$ ions can be increased via any known means, including the use of acids, electrical current, the addition of hydrogen peroxide, and the use of a membrane; or even in-situ production of the $H^+$ ions. Of course, the practitioner would not use the ion exchange process if one wanted to increase the amount of $H^+$ ions without removing cations. The addition of a small amount of acid is depicted in FIG. 3.

Increasing the amount of $H^+$ ions, or protons, in-situ can be accomplished by adding a compound which does not contain $H^+$ ions capable of disassociating in water, but rather catalyzes a reaction, or the compound itself reacts, with component(s) already present in the liquid biomass feed stream. For example, $AlCl_3$ contains no $H^+$ ions. However, when added to the liquid biomass feed stream, the $AlCl_3$ will react with the water in the liquid biomass feed stream to form $Al(OH)_3$ and HCl, thus creating the $H^+$ ion. In this manner, the amount of the $H^+$ ions are increased without adding $H^+$ ions to the liquid biomass feed stream. This embodiment is demonstrated in FIG. 4, where the aluminum chloride would be added via stream 6.

In the case of decationization, the pH of the decationized stream becomes lower than the pH of the feedstream. The pH that can be achieved with decationization depends on the initial cation concentration in the feed liquid, the cations added to the stream, the ion resin exchange capacity, specific velocity through the resin and temperature of exposure.

Therefore, the decationization should occur at a temperature in the range of 5° C. to 60° C., for a time sufficient to lower the pH of the liquid biomass feed stream at least 0.5 units, with 1.0 units being more preferable, and 1.25 being most preferable.

For a reasonable hydrolysis reaction, an acidic stream pH below at least 3.0 is most efficient. Therefore, the pH of the acidic stream should be less than 3.0, more preferably less than 2.5, more preferably less than 2.0, more preferably less than 1.5, and even more preferably less than 1.39. More preferred is less than 1.2, with less than 1.0 being preferred as well. One of ordinary skill knows that pH has a lower theoretical limit of up to but not including 0, thus each of the above numbers can be expressed as the upper limit of the pH of the acidic stream, with the pH being greater than, but not including, 0.0.

Once the desired pH is reached, the acidic stream is hydrolyzed (vessel 20) by increasing the temperature of the acidic stream to a hydrolysis temperature greater than 80° C., and preferably within the range of 80° C. to 200° C. Other ranges are 80° C. to 180° C., 100° C. to 180° C., 95° C. to 180° C., 120° C. to 180° C. and 120° C. to 170° C. the most preferred. The hydrolysis temperature is maintained for a time sufficient to hydrolyze the components (oligosaccharides) to the degree desired. As shown in the experimental section, the time for hydrolysis can be as little as less than 1 second. As shown in the experimental section it is possible to obtain hydrolysis yields close to 95%, without addition of any acid into the stream, and significantly reducing degradation products.

The phrase acid means homogeneous acid which is a compound that disassociates in water to become at least partially soluble and in so doing donates at least one proton [$H^+$]. While some acid may be added to the process, the amount of acid added should be such that the amount of the $H^+$ ions derived from the acid or acids in combination should be less than 80% of the total amount of $H^+$ ions added to the process, regardless of addition location. In addition to disassociating with water, the acid will react with a base to form a salt. While having less than 80% of the total amount of $H^+$ ions added to the process be derived from an acid or acids is preferred, less than 90% is even more preferred, with less than 95% being another preferred level, with no amount of $H^+$ ions added to the process being derived from an acid or acids the most preferred; regardless of addition location.

One way to achieve these levels is to add the $H^+$ ions at least in part, if not all, from the group selected from decationization and in situ generation. It has been observed that the lower the pH of the acidic stream, the lower the temperature and time needed for hydrolysis. Because pH is a logarithmic measure, the relationship of lower pH is not believed to be linear with the reduced temperature and time. The results so far, indicate that it is the time at the higher hydrolysis temperatures (>120° C.) which should be minimized so as to keep the degradation products minimal.

In this way, the use of traditionally large amounts of acid or acids used in the hydrolysis step is avoided, allowing the passage from a rather harsh treatment to a totally mild one and the consumption of acid used can be reduced to the amount needed to regenerate the cationic resin (or not used at all). The acid is then recovered in a separate stream and then more easily disposed of.

At the same time, the final hydrolysed stream is a cleaner liquid, containing almost exclusively monomeric sugars, low content of salts and low amount of degradation products that could hinder subsequent chemical or biological transformations of the sugars.

Experimental

The feedstock of the experiments was derived from the pre-treatment of Arundo Donax by soaking in water at 155° C. for 117 minutes. In the first set of experiments, the solids were removed and the suspended solids were removed by nanofiltration.

The starting pre-treated liquid, contained a xylo-oligomers (47 g/L (47.3)) and gluco-oligomers (18 g/L (17.7)), had a composition shown in Table 1, with a pH of 3.94.

As a first control, the pre-treated, but not decationized stream was held at 150° C. for 60 minutes. After this autohydrolysis treatment, the composition of the sample was almost the same as the one at the beginning. This indicates that the pre-treated stream does not undergo autohydrolysis, but needs a catalyst or different conditions.

The filtered stream obtained from mild pre-treatment of biomass (see composition in Table 1) was decationized using a glass column containing 400 ml of cationic resin in acid form (Relite RPS, available from) with a flow rate of 4 BV/h (bed volume/hour).

The resulting decationized stream contained 15% of initial cations (85% removed) and the resulting pH was 0.96. Moreover, about 23% of the starting unknown soluble compounds were removed. The lowest pH achieved so far with decationization has been 0.89.

The hydrolysis tests at 121° C. were carried out in an autoclave, while hydrolysis tests at 150° C. and 170° C. were carried out in a Parr reactor.

All the results of experiments carried out, are reported in the table below, and the effects of the hydrolysis are shown in the graphs corresponding to Table 2.

TABLE 1

FEED STREAM COMPOSITIONS AND COMPARATIVE EXAMPLE RESULTS

| | Feed Stream after Nano filtration | Decationized Feed Stream | Auto hydrolysis of Feed Stream CE-1 | Hydrolysis by Acid Addition CE-2 | Hydrolysis by Acid Addition CE-3 |
|---|---|---|---|---|---|
| Hydrolysis Time (min) | — | — | 60 | 30 | 30 |
| Hydrolysis Temp (° C.) | — | — | 150 | 121 | 121 |
| pH Before Hydrolysis | 3.94 | 0.96 | 3.94 | 1.05 | 0.73 |
| pH After Hydrolysis | | | 3.93 | 1.12 | 0.71 |
| Sulfuric Acid Added (%, w/w) | | | | 1.50 | 4.10 |
| Glucose (g/L) | 0.7 | 1.1 | 0.8 | 2.5 | 15.1 |
| Xylose (g/L) | 5.5 | 6.2 | 5.6 | 14.8 | 48.1 |
| 5-HMF (g/L) | 0.5 | 0.3 | 0.6 | 0.7 | 0.3 |
| Furfural (g/L) | 1.6 | 0.9 | 1.6 | 2.9 | 2.5 |
| Gluco oligomers (g/L) | 17.7 | 18.6 | 17.6 | 16.9 | 4.6 |
| Xylo oligomers (g/L) | 47.3 | 48.8 | 47.4 | 38.2 | 5.3 |
| Soluble Acetyls (g/L) | | 2.7 | 3.2 | 2.1 | 1.2 |
| Other Soluble Compounds (g/L) | 86.9 | 68.2 | 77.7 | 45.9 | 64.2 |
| $[H^+]$ g-mol $H^+$/L before Hydrolysis | 0.0001 | | | 0.089 | 0.186 |
| $[H^+]$ g-mol $H^+$/L before Hydrolysis | | | | 0.076 | 0.195 |
| Monovalent cations (g/L) | 1.8 | 0.2 | Not measured | | |
| Bivalent cations (g/L) | 1.9 | 0.6 | Not measured | | |

TABLE 2

HYDROLYSIS RESULTS OF WORKING EXAMPLES A-E.

| | WE-A | WE-B | WE-C | WE-D | WE-E |
|---|---|---|---|---|---|
| Hydrolysis Time (min) | 0.0001* | 20 | 27 | 30 | 30 |
| Hydrolysis Temp (° C.) | 150 | 150 | 170 | 121 | 121 |
| pH Before hydrolysis | 0.96 | 0.96 | 0.96 | 0.96 | 0.73 |
| pH After Hydrolysis | 1.12 | 1.02 | 1.04 | 0.99 | 0.85 |
| Sulfuric Acid Added (%, w/w) | 0 | 0 | 0 | 0 | 1.23 |
| Glucose (g/L) | 14.7 | 18.8 | 16.9 | 5.9 | 16.1 |
| Xylose (g/L) | 55.6 | 50.9 | 35.1 | 48.3 | 53.7 |
| 5-HMF (g/L) | 0.4 | 1.2 | 1.7 | 0.3 | 0.5 |
| Furfural (g/L) | 1.2 | 3.9 | 8.0 | 0.9 | 2.0 |
| Gluco oligomers (g/L) | 4.2 | 1.6 | 1.6 | 12.4 | 5.1 |
| Xylo oligomers (g/L) | 0.0 | 0.4 | 0.0 | 6.4 | 0.4 |
| Soluble Acetyls (g/L) | 0.2 | 0.1 | 0.0 | 0.7 | 0.5 |
| Other Soluble Compounds (g/L) | 68.0 | 55.5 | 61.6 | 71.4 | 66.8 |
| Total Free Protons calculated from pH [$H^+$] g-mol $H^+$/L before and after hydrolysis | 0.110 | 0.110 | 0.110 | 0.110 | 0.186 |
| Protons from sulfuric acid | 0.076 | 0.095 | 0.091 | 0.102 | 0.141 |

Note:

0.0001 minutes means that temperature was brought up to 150° C. and immediately lowered again, meaning that, given the heating behaviour of the system, liquid was subjected to a temperature between 120 and 150° C. for a total of seven minutes.

*In Sample E, Sulfuric Acid was added to the solution until a pH of 0.73 was reached corresponding to a concentration of sulfuric acid of 1.23% (w/w). One can calculate by difference, the amount of increase of the $H^+$ ions due to decationization and how much was due to the addition of the sulfuric acid.

The next set of experiments were done using a Wheat Straw feed stream, soaked in water at 155° C., for 72 minutes without nanofiltration.

The stream was concentrated by removing 50% of the water before decationization and another 50% by weight after decationization. The pH before hydrolysis was 0.93. This analysis is shown in Table 3.

TABLE 3

APPLICATION OF PROCESS TO WHEAT STRAW.

| | Feed Stream Before Hydrolysis | Product Stream After Hydrolysis WE-F |
|---|---|---|
| Hydrolysis Time (min) | | 0.0001* (see note above) |
| Hydrolysis Temp (° C.) | | 142 |
| pH Before Hydrolysis | 0.93 | 0.93 |
| pH After Hydrolysis | | 0.88 |
| Sulfuric Acid Added (%, w/w) | 0 | 0 |
| Glucose (g/L) | 2.5 | 36.3 |
| Xylose (g/L) | 16.5 | 91.6 |
| 5-HMF (g/L) | 0.2 | 0.7 |
| Furfural (g/L) | 0.0 | 2.2 |
| Gluco oligomers (g/L) | 35.1 | 7.4 |
| Xylo oligomers (g/L) | 79.0 | 11.6 |
| Soluble Acetyls (g/L) | 2.4 | 1.5 |
| Other Soluble Compounds (g/L) | 68 | 49 |

The next set of experiments were on concentrated streams. Table 4 shows the effects of concentrating the streams as indicated in the table. Table 5 shows the hydrolysis conversion in percent, establishing the effectiveness of the disclosed process.

TABLE 4

RESULTS OF VARIOUS CONCENTRATION STEPS

| | WE-H | WE-I | WE-J | WE-K | WE-L |
|---|---|---|---|---|---|
| Hydrolysis Time (min) | 0.001 | 0.001 | 0.001 | 0.001 | 0.001 |
| Hydrolysis Temp (° C.) | 153 | 124 | 150 | 151 | 149 |
| pH Before Hydrolysis | 0.83 | 0.83 | 0.83 | 0.83 | 0.54 |
| pH After Hydrolysis | 0.90 | 0.97 | 0.96 | 0.95 | 0.62 |
| Concentration Before Decationization | 2x | 2x | 2x | 2x | None |
| Concentration After Decationization | 2x | 2x | 3x | 4x | 8x |
| Concentration Before Hydrolysis | | | | | |
| Glucose (g/L) | 1.3 | 1.3 | 3.8 | 2.0 | 1.9 |
| Xylose (g/L) | 4.6 | 4.6 | 11.0 | 11.9 | 11.1 |
| 5-HMF (g/L) | 0.3 | 0.3 | 0.4 | 0.4 | 0.4 |
| Furfural (g/L) | 0.1 | 0.1 | 0.0 | 0.0 | 0.0 |
| Gluco oligomers (g/L) | 39.3 | 39.3 | 70.9 | 99.1 | 100.5 |
| Xylo oligomers (g/L) | 39.6 | 39.6 | 73.1 | 105.9 | 104.1 |
| Soluble Acetyls (g/L) | 61.9 | 61.9 | 143.3 | 182.4 | 169.8 |
| Other Soluble Compounds (g/L) | 6.1 | 6.1 | 14.1 | 0.0 | 22.6 |
| Concentration After Hydrolysis | | | | | |
| Glucose (g/L) | 34.2 | 16.5 | 52.5 | 55.0 | 56.8 |
| Xylose (g/L) | 41.3 | 43.6 | 71.3 | 65.4 | 60.9 |
| 5-HMF (g/L) | 1.2 | 0.4 | 1.8 | 3.9 | 2.2 |
| Furfural (g/L) | 2.8 | 0.5 | 5.3 | 14.6 | 9.1 |
| Gluco oligomers (g/L) | 11.1 | 24.2 | 41.0 | 51.0 | 8.3 |
| Xylo oligomers (g/L) | 9.6 | 7.0 | 29.0 | 29.1 | 7.7 |
| Soluble Acetyls (g/L) | 3.2 | 0.9 | 6.3 | 8.1 | 3.3 |
| Other Soluble Compounds (g/L) | 65.6 | 82.6 | 116.2 | 165.6 | 97.5 |

TABLE 5

PERCENT YIELDS OF XYLOSE AND GLUCOSE DERIVATIVES FROM ARUNDO DONAX

| | XYLOSE DERIVATIVE YIELD (% of Total) | | | GLUCOSE DERIVATIVE YIELDS (% of Total) | | |
|---|---|---|---|---|---|---|
| | Monomer | Oligomer | Degradation Products | Monomer | Oligomer | Degradation Products |
| Auto hydrolysis | | 100 | | | 100 | |
| CE-1 | | | | | | |
| CE-2 | 18 | 78 | 4 | 7 | 91 | 2 |

TABLE 5-continued

| PERCENT YIELDS OF XYLOSE AND GLUCOSE DERIVATIVES FROM ARUNDO DONAX | | | | | | |
|---|---|---|---|---|---|---|
| | XYLOSE DERIVATIVE YIELD (% of Total) | | | GLUCOSE DERIVATIVE YIELDS (% of Total) | | |
| | Monomer | Oligomer | Degradation Products | Monomer | Oligomer | Degradation Products |
| CE-3 | 86 | 11 | 3 | 75 | 25 | |
| WE A | 94 | 1 | 5 | 72 | 27 | 1 |
| WE B | 89 | | 10 | 85 | 8 | 7 |
| WE C | 58 | | 42 | 76 | 8 | 16 |
| WE D | 83 | 15 | 2 | 24 | 65 | 12 |
| WE E | 98 | | 2 | 65 | 22 | 13 |
| WE-F (average of multiple trials) | 90.3 | 6.4 | 3.3 | 81.6 | 16.9 | 1.6 |
| WE-H | 70.7 | 8.3 | 21.0 | 70.7 | 2.8 | 26.5 |
| WE-I | 81.8 | 1.4 | 16.8 | 35.8 | 0.4 | 63.8 |
| WE-J | 59.5 | 8.1 | 32.4 | 50.7 | 2.0 | 47.3 |
| WE-K | 49.4 | 20.7 | 30.0 | 46.3 | 4.4 | 49.3 |
| WE-L | 70.7 | 8.3 | 21.0 | 70.7 | 2.8 | 26.5 |

We claim:

1. A process for the hydrolysis of a liquid biomass feed stream derived from pre-treated lingo-cellulosic biomass comprising cations in the form of inorganic salts and xyloligomers containing xylose, wherein the process comprises the steps of A. creating an acidic stream from the liquid biomass feed stream by decationization of the liquid biomass feed stream using an ion exchange media to increase the number of $H^+$ ions to the liquid biomass feed stream in an amount sufficient so that the pH of the acidic stream is at least 0.5 pH units less than the pH of the liquid biomass feed stream prior to the addition of the $H^+$ ions wherein less than 90% of the total amount of $H^+$ ions added to the feed stream are derived from an acid or acids, B. separating at least a portion of the acidic stream from the ion exchange media, and C. hydrolyzing the at least a portion of the acidic stream in the absence of any ion exchange media by increasing the temperature of the acidic stream to a hydrolysis temperature in the range of between 150° C. and 200° C.

2. The process according to claim 1, wherein less than 80% of the total amount of $H^+$ ions added to the feed stream are derived from an acid or acids.

3. The process according to claim 1, wherein the pH of the acidic stream is less than at least 2.5.

4. The process according to claim 1, wherein at least a portion of the $H^+$ ions is derived from an acid added to either the feed stream or the acidic stream, or both prior to hydrolysis.

5. The process according to claim 1, wherein less than 25% of the total amount of $H^+$ ions added to the process come from an acid or acids.

6. The process according to claim 1, wherein at least a portion of the $H^+$ ions is derived from an acid or acids added to the acidic stream during the hydrolysis step.

7. The process according to claim 1, wherein a salt is added to the process.

8. The process according to claim 7, wherein at least a portion of the salt is added to the feed stream prior to adding the $H^+$ ions to the feed stream.

9. The process according to claim 1, wherein the temperature of the acidic stream is maintained in the hydrolysis temperature range for a time within the range of 1 sec to 4 hours.

10. The process according to claim 1, wherein the concentration of the xyloligomers in the feed stream is increased prior to decationization.

11. The process according to claim 1, wherein the acidic stream comprises a concentration of xyloligomers and the concentration of the xyloligomers in the acidic stream is increased prior to hydrolysis.

* * * * *